US005722799A

United States Patent [19]

Hilfiker

[11] Patent Number: 5,722,799

[45] Date of Patent: Mar. 3, 1998

[54] WIRE EARTHEN RETENTION WALL WITH SEPARATE FACE PANEL AND SOIL REINFORCEMENT ELEMENTS

[76] Inventor: William K. Hilfiker, 2202 Lakeridge Dr., Grapevine, Tex. 76051

[21] Appl. No.: 652,321

[22] Filed: May 23, 1996

[51] Int. Cl.[6] ..... E02D 5/00

[52] U.S. Cl. ..... 405/262; 405/284; 405/286

[58] Field of Search ..... 405/262, 284, 405/286, 258, 287, 273, 272

[56] References Cited

U.S. PATENT DOCUMENTS

| | | | |
|---|---|---|---|
| 4,117,686 | 10/1978 | Hilfiker | 405/284 |
| 4,329,089 | 5/1982 | Hilfiker et al. | 405/287 X |
| 4,391,557 | 7/1983 | Hilfiker et al. | 405/287 |
| 4,505,621 | 3/1985 | Hilfiker et al. | 405/258 X |
| 4,643,618 | 2/1987 | Hilfiker et al. | 405/287 |
| 4,856,939 | 8/1989 | Hilfiker | 405/284 |
| 4,961,673 | 10/1990 | Pagano et al. | 405/262 X |
| 5,531,547 | 7/1996 | Shimada | 405/262 |

*Primary Examiner*—Dennis L. Taylor
*Attorney, Agent, or Firm*—Limbach & Limbach LLP

[57] ABSTRACT

A retaining wall for an earthen formation uses welded wire face mats having upright portions secured to one another and spanning the distance between successive lifts of the wall at the face of the formation. Elongate welded wire soil reinforcing mats with bent-up ends of a height less than the distance between successive lifts are secured to the face mats so as to extend partially over the upright portions and into the earthen formation. The bent-up ends of the soil reinforcing mats are formed with kinks which extend through the upright portions of the face mats. Rods extend through these kinks to secure the upright portions of the face mats against separation from the bent-up ends of the soil reinforcing mats. In a preferred embodiment, the face mats have a width greater than the width of the soil reinforcing mats and the soil reinforcing mats at each lift of the wall are spaced from one another and span adjacent face mats.

48 Claims, 12 Drawing Sheets

WIRE EARTHEN RETENTION WALL WITH SEPARATE FACE PANEL AND SOIL REINFORCEMENT ELEMENTS

BACKGROUND OF THE INVENTION

The present invention relates to a soil reinforced wall for retaining earthen formations and, in particular, is directed to such a wall wherein the soil reinforcing elements comprise welded wire mats and the face panels for the wall are constructed of separate welded wire mats secured to the soil reinforcing mats. It is especially concerned with such an arrangement wherein the lift (i.e., the distance between successive soil reinforcing mats) may be increased as compared to the walls presently in use and the face panel mats and soil reinforcing mats may be individually designed and placed to optimize the their respective functions.

The prior art relating to soil reinforced earthen retaining walls wherein the retaining and face elements comprise gridwork like mats is typified by U.S. Pat. Nos. 4,117,686, 4,505,621 and 4,856,939 by William K. Hilfiker, the inventor herein. In the '686 patent, unitary angle-shaped welded wire mats provide both the soil reinforcing structure and the face structure of the wall. In certain embodiments, backing mats are provided behind the face portions of the soil reinforcing mats to add to the integrity of the wall and reduce the size of the openings in its face portion. The '621 patent also teaches a wire mat soil reinforced retaining wall wherein unitary mats provide both the face and soil reinforcing components of the wall. With the wall of the later patent, a fine grid mat may be placed to the inside of the face component of the reinforcing mats. The '939 patent teaches a soil reinforced wall wherein the reinforcing elements comprise geogrid mats which serve both as the reinforcing and face components of the wall. Although the later patent teaches a separate welded wire gridwork to support the face component of the geogrid mat, this gridwork serves primarily to support the face component and does not have reduced sized openings, as compared to the geogrid mat.

In the prior art where unitary mats provide both the soil reinforcing and face components of a retaining wall, the components are of generally the same width and the density of the mat gridwork is a compromise to accommodate both the face and soil reinforcing functions. This typically requires more than the optimum amount of material.

SUMMARY OF THE INVENTION

The present invention provides a welded wire face mat and an elongate angle-shaped welded wire soil reinforcing mat which complementarily engage one another. In one embodiment, the face mat has a relatively short floor portion for extension into the earthen formation and an upright portion of an extended height for disposition over the face of the formation. In another embodiment, the face mat has an upright portion of extended height and fingers extending from it's upper and lower edges for engagement over the face mats thereabove and therebelow. In both of these embodiments, the reinforcing mat has a bent-up end of a height less than that of the upright portion of the face mat and an elongate body for embedment in an earthen formation. Means are provided for securing the bent-up end of the soil reinforcing mat to the upright portion of the face mat, thus reinforcing the face mat. The bent-up end may initially extend at an angle of less than 90° with respect to the elongate body and be so constructed as to deflect to a condition extending at 90° with respect to the elongate body upon compaction of backfill behind the face mat.

A principal object of the invention is to provide an apparatus and method for the fabrication of soil reinforced retaining walls wherein separate welded wire mats provide the face and soil reinforcing components of the wall.

Another object related to the later object is to provide such a method and apparatus wherein the physical structure of the soil reinforcing and face components of the wall may be different and chosen to optimize their function and the use of material.

Still another object of the invention is to provide a soil reinforced retaining wall wherein the lift between successive soil reinforcing elements may be increased, as compared to what is customary in the art.

Yet another object of the invention is to provide a soil reinforced retaining wall for earthen formations wherein the soil reinforcing components of the wall comprise angle-shaped welded wire mats; which mats serve to anchor and reinforce the face mat of the wall, without extending over its full height.

A further object of the invention is to provide a soil reinforced earthen retaining wall wherein the soil reinforcing and face components of the wall comprise separate welded wire mats and an improved connection is provided for securing the mats together.

Another object of the invention is to provide a soil reinforced earthen retaining wall wherein the soil reinforcing and face components of the wall comprise separate wire mats and the soil reinforcing mats may extend over less than the full width of the face mats and be used to secure adjacent face mats together.

Another object of the invention is to provide a soil reinforced retaining wall for earthen formations wherein the soil reinforcing and face components of the wall are separate and the face components are engaged behind bent-up ends of the soil reinforcing components which initially extend at less than 90° with respect to horizontal and deflect to a condition extending at generally 90° to horizontal upon compaction of soil behind the wall.

A further object of the invention is to provide a soil reinforced retaining wall wherein face panels initially extend at an acute angle with respect to soil reinforcing mats to resist compactive force from backfill placement.

Yet another object of the invention is to provide a soil reinforced earthen retaining wall wherein the soil reinforcing and face components of the wall comprise separate wire mats and wherein the face components are of an extended height and provided with means to enable successive face components to be secured together.

These and other objects will become apparent when viewed in light of the following detailed description and accompanying drawings.

DESCRIPTION OF THE FIRST EMBODIMENT

Figure 1:
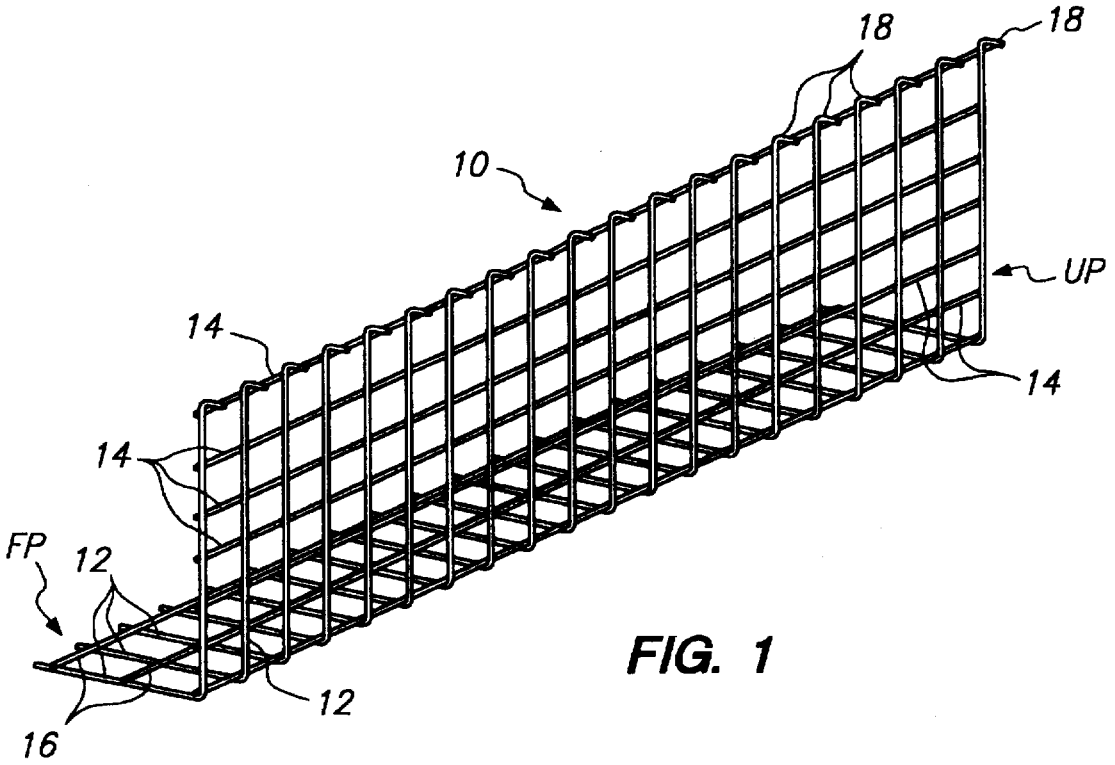
FIG. 1 is a perspective view of a welded wire face mat constructed according to a first embodiment of the present invention.

The welded wire face mat shown in FIG. 1 is designated in its entirety by the numeral 10 and comprises a floor portion FP and an upright portion UP. Longitudinal wires 12 extend lengthwise across the floor and upright portions. Transverse wires 14 are welded to and extend across the wires 12 in the upright portion of the mat 10. Transverse wires 16 are welded to and extend across the wires 12 in the floor portion FP. The wires 12, 14 and 16 may typically be W3.5 to W12 wire and covered with an anticorrosive coating, such as zinc. While the proportions of the face mat 10 may vary, in one exemplary embodiment, the mat, as viewed in FIG. 1, has a width of 6 feet, a height of 2 feet and a depth measured across the floor portion FP of 16 inches. In this embodiment, the longitudinal wires 12 are spaced by 6 inches, the transverse wires 14 in the upright portion UP are spaced by 3 inches and the transverse wires 16 in the floor portion FP are spaced by 6 to 12 inches. The longitudinal wires 12 terminate in panel prongs 18 extending outwardly from the upper distal edge of the upright portion UP by approximately 1½ inches.

Figure 2:
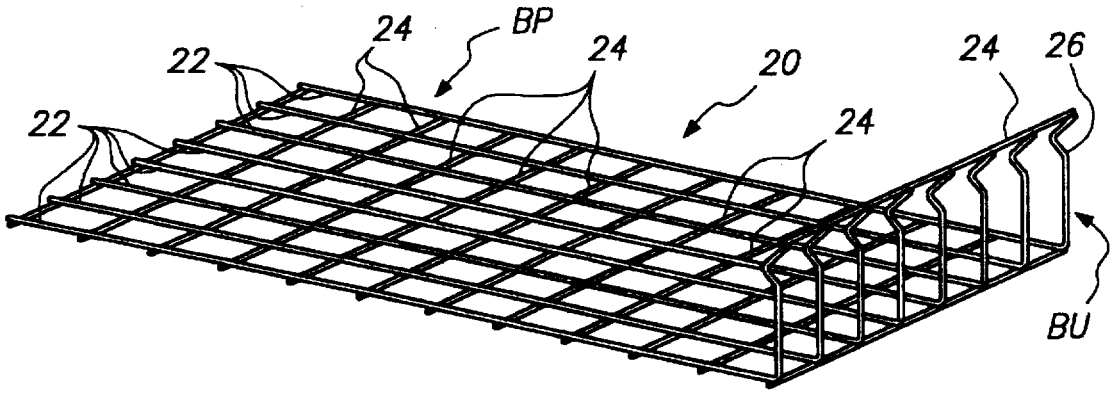
FIG. 2 is a perspective view of a welded wire soil reinforcing mat constructed according to the first embodiment of the present invention.
Figure 3:
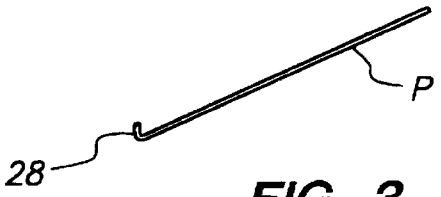
FIG. 3 is a perspective view of a rod which may be used to secure the face and soil reinforcing mats of the inventive wall together.

The soil reinforcing mat shown in FIG. 2 is designated in its entirety by the numeral 20 and comprises an elongate base portion BP and a bent-up end BU. The longitudinal wires of the mat 20 are designated 22 and the transverse wires are designated 24. These wires are typically W3.5 to W12 wire and are welded together at their intersections and coated with a suitable anticorrosive coating, such as zinc. Typical dimensions for the mats 20, as viewed in FIG. 2, are 3½ feet wide, 8 to 10 inches high, as measured over the height of the bent-up portion BU, and 0.7 times the wall height for the length of the base portion BP. With such dimensions, the wires 22 may be spaced by 6 to 12 inches and the wires 24 may be spaced by 12 to 24 inches. The longitudinal wires 22 extending across the bent-up portion BU are formed with inwardly extending kinks 26 disposed for extension through the upright portion UP of the face mat 10. These kinks are adapted to have a retaining rod or pin P (see FIG. 3) extended therethrough. The rod P has a length equal to or slightly greater than the width of the soil reinforcing mats 20. A bent-end 28 is formed on one end of the rod to facilitate its insertion and limit the degree to which it can be extended through the kinks 26.

Figure 5:
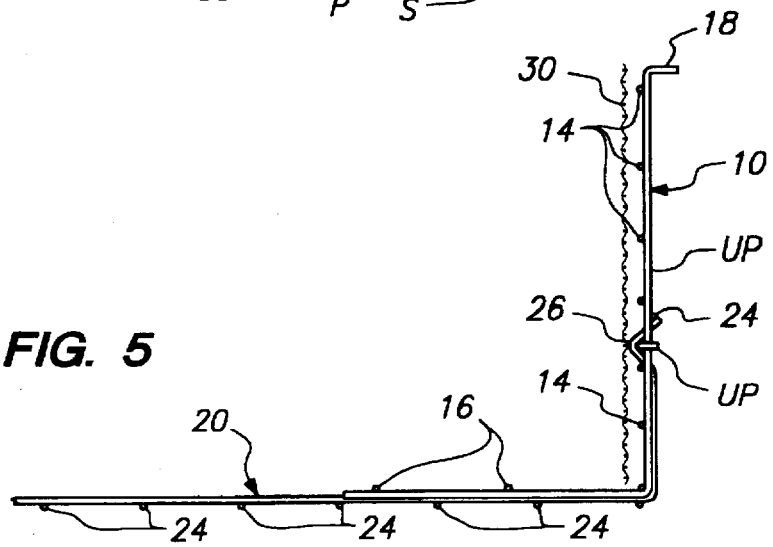
FIG. 5 is a cross-sectional elevational view of the soil reinforcing and face mat combination of the first embodiment of the present invention, as secured together by the rods shown in FIG. 3, with a filter mat shown behind the face mat.

The first embodiment mats are assembled as shown in FIG. 5 with the face mat 10 nested with and disposed over the soil reinforcing mat 20 and the kinks 26 extending through the upright portion UP of the face mat and secured in place by a retaining pin P. A filter mat or wire screen 30 extends over and is disposed to the interior of the upright portion UP. From FIG. 5 it will also be seen that the mats 10 and 20 assume complemental juxtaposed condition when nested together with the fold line between the floor portion FP and upright portion UP of the face mat 10 coinciding with the fold line between the base portion BP and bent-up portion BU of the soil reinforcing mat 20.

Figure 4:
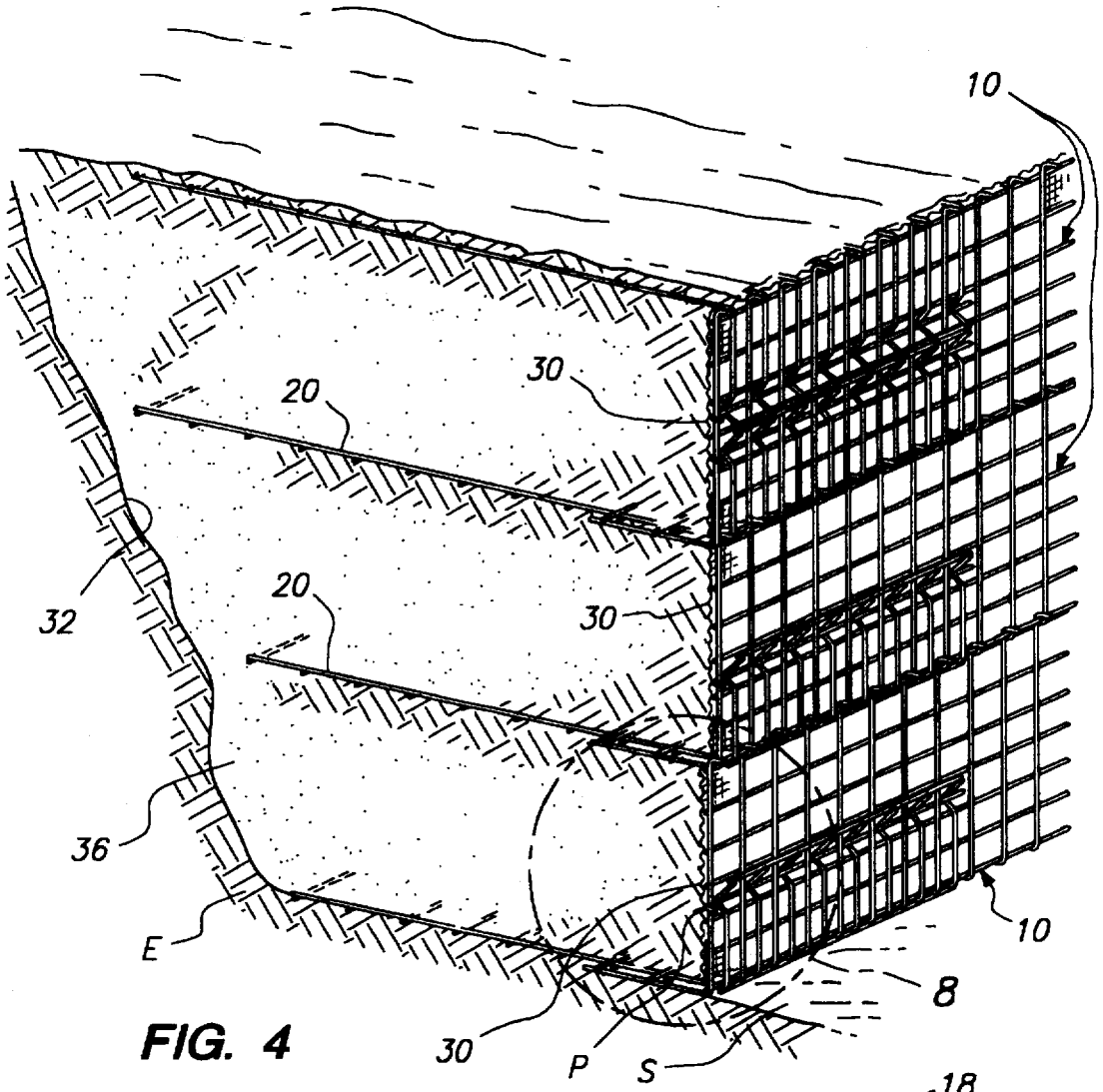
FIG. 4 is a perspective view of a soil reinforced retaining wall constructed according to the first embodiment of the present invention.

FIG. 4 shows a soil reinforced wall constructed according to the first embodiment of the present invention. As there illustrated, the earthen formation is designated E and is shown having a cut face 32. In erecting the wall shown in FIG. 4, the lowermost soil reinforcing mat 20 is first placed on the surface S of the formation with the bent-up portion BU extending upwardly. The lowermost face mat 10 is then placed over the soil reinforcing mat 20 and secured in place with a retaining rod P. Filter mat 30 is then placed behind the upright portion UP and backfill soil 36 is filled in behind the mat and compacted to the approximate level of the top of the upright portion UP of the lowermost face mat.

With the lowermost face mat and soil reinforcing mat in place and backfill soil disposed thereover as described above, the second level face mat 10 and soil reinforcing mat 20 are assembled and then hooked over the panel prongs 18 of the lowermost face mat and placed on top of the drainrock and backfill soil therebeneath as shown in FIG. 4. This completes the lift between the lowermost soil reinforcing mat and the second level reinforcing mat. The next lift is then completed by placing a filter mat 30 behind the second face mat and filling drainrock 34 and compacted soil 36 behind said filter mat to the approximate level of the top of the second level face mat 10. The process of successively assembling face and soil reinforcing mats into the condition shown in FIG. 5 and then hooking them over the prongs 18 of the face mat therebelow is then repeated to complete the second lift. Filter mat 30 and backfill 36 is then again placed to the level of the top of the next face mat so placed.

When the composite soil reinforced wall reaches the top of the earthen formation to be retained, the process is complete. Final anchoring of the upper end of the uppermost face mat can be achieved by inverting a soil reinforcing mat and hooking it over the face mat therebelow, as shown at the top of FIG. 4.

Figure 6:
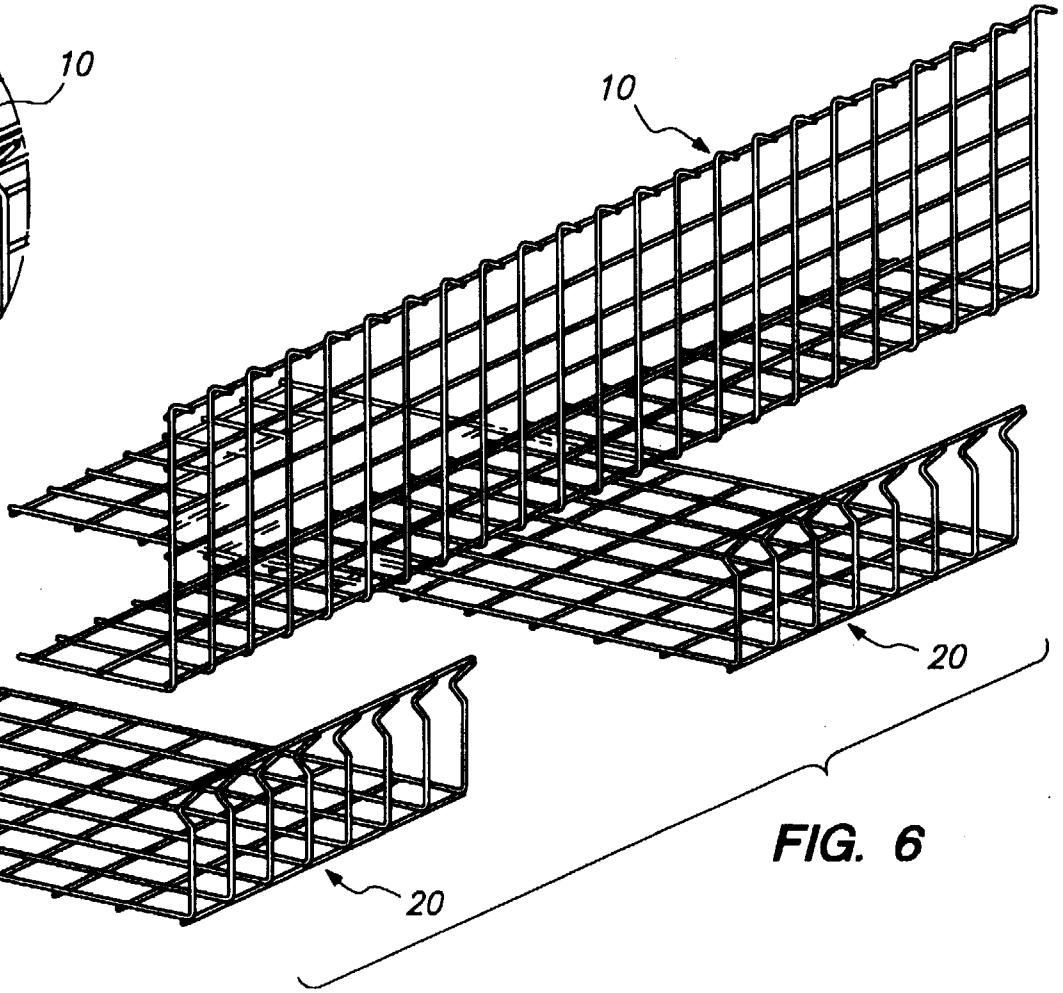
FIG. 6 is an exploded perspective view showing the interrelationship between a face mat and a pair of soil reinforcing mats constructed according to the first embodiment of the present invention.
Figure 8:
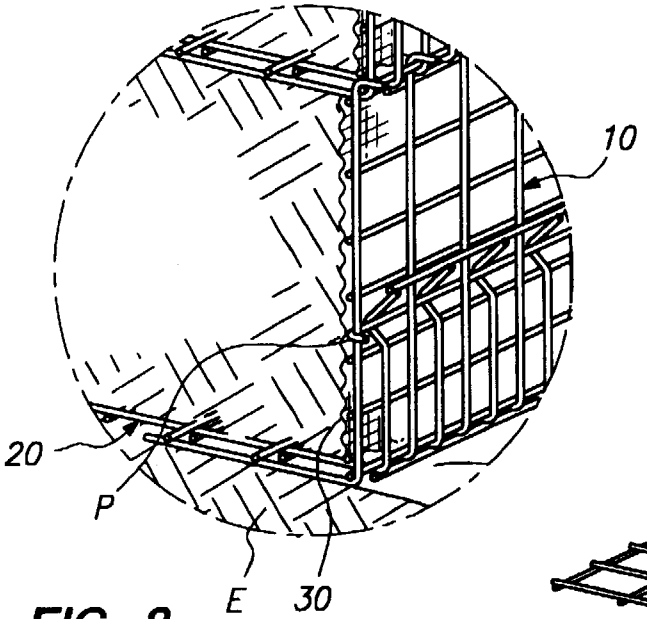
FIG. 8 is an enlarged perspective view taken within the circle 8 of FIG. 4.

FIG. 6 shows how a pair of the first embodiment soil reinforcing mats 20 may be disposed below and at either end of a face mat 10. As shown in this figure, the soil reinforcing mats are spaced and the face mat is exploded thereabove. In the assembled (non-exploded) condition, the face mat 10 would be nested with the soil reinforcing mats 20 and held in place by retaining pins P.

Figure 7:
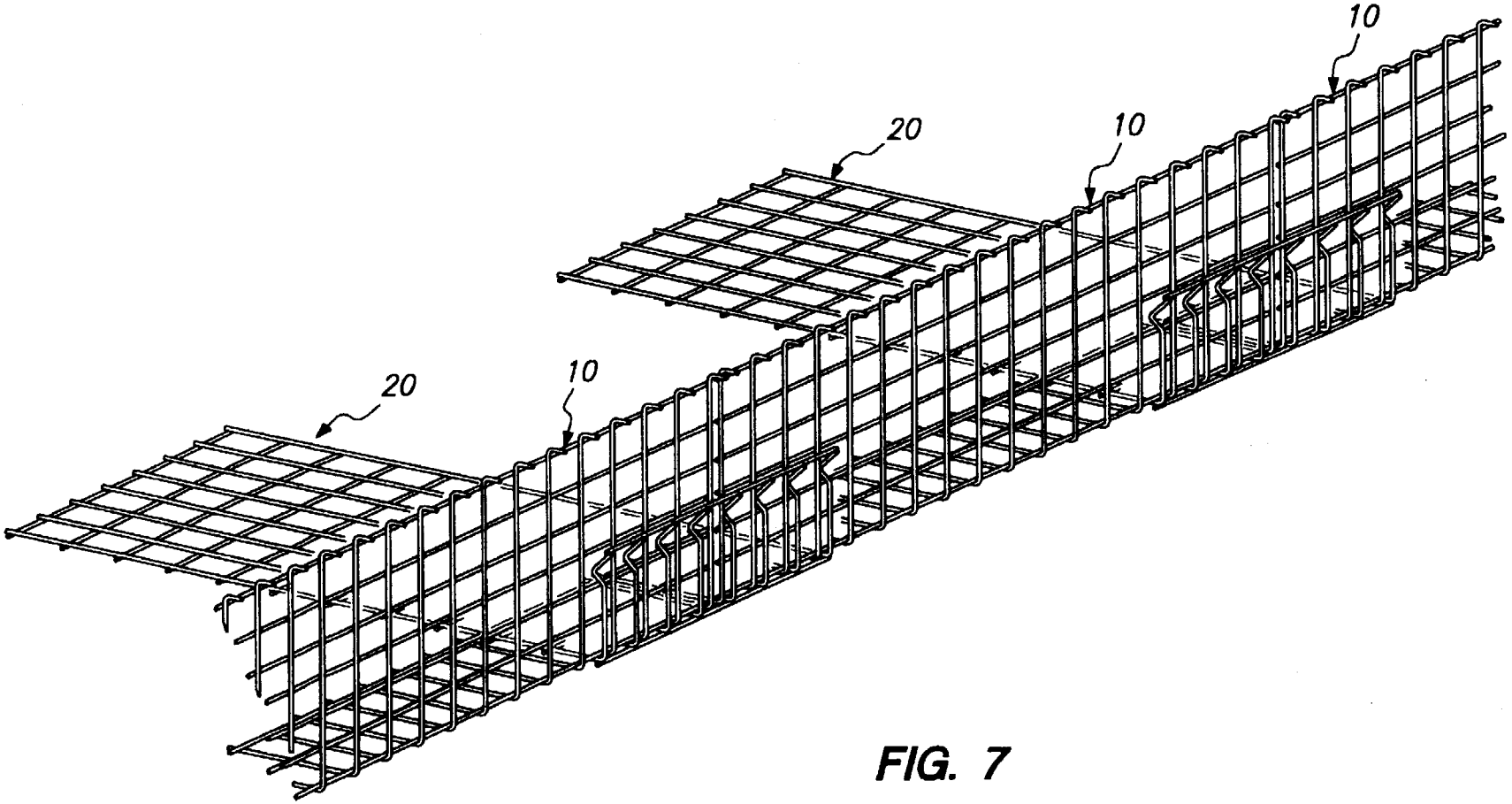
FIG. 7 is a perspective view of the combined face and soil reinforcing mat components of the first embodiment of the present invention, with a series of face mats shown in edge-to-edge relationship and the soil reinforcing mats shown in spanning relationship thereto.

FIG. 7 shows a fully assembled course of three of the first embodiment face mats 10 disposed in edge-to-edge relationship with a pair of soil reinforcing mats 20 disposed thereunder and in spanning relationship to the juxtaposed edges of adjacent face mats. From this figure, it will be appreciated that the soil reinforcing mats perform three distinct functions, namely: (1) they serve to reinforce the earthen formation; (2) they serve to secure adjacent face mats together in aligned edge-to-edge relationship; and (3) they serve to anchor the face mats against displacement away from the soil reinforced earthen formation. It should also be appreciated that spacing of the soil reinforcing mats reduces the amount of steel used in the retaining wall and may accommodate passage of the soil reinforcing mats around obstructions within the earthen formation. Successive levels of the soil reinforcing mats may be staggered to further achieve a uniform reinforcement of the earthen formation. Such staggering would mean that the juxtaposed edges of the face mats from one level to another are staggered, as are the soil reinforcing mats which overlap these edges.

DESCRIPTION OF THE SECOND EMBODIMENT

Figure 9:
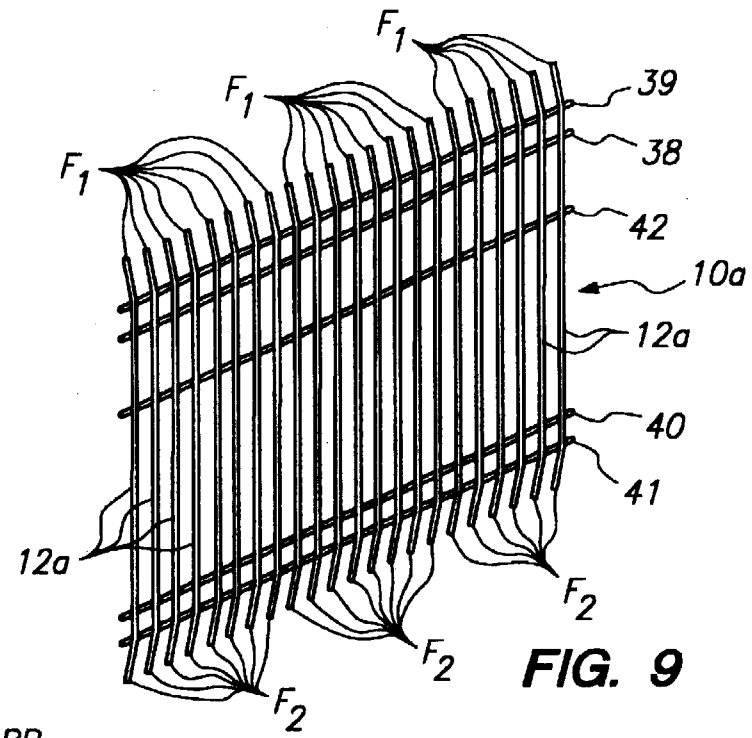
FIG. 9 is a perspective view of a welded wire face mat constructed according to a second embodiment of the present invention.

The welded wire face mat shown in FIG. 9 is designated in its entirety by the numeral 10*a* and comprises longitudinal wires 12*a* spaced from one another by approximately 3 inches; upper transverse wires 38 and 39 welded to an extending across the longitudinal wires 12*a*; lower transverse wires 40 and 41 welded to and extending across the longitudinal wires 12*a*; and, an intermediate transverse wire 42 welded to and extending across the longitudinal wires 12*a*. The ends of the longitudinal wires 12*a* extend beyond the uppermost transverse wire 39 and the lowermost transverse wire 41 by approximately 4 inches to define fingers F1 and F2 which extend inwardly relative to the main body of the face mat at an angle of approximately 5° to 10°. In a typical embodiment, the distance between the upper transverse wire 39 and the lowermost transverse wire 41 is two feet, the wires 38 and 39 are spaced from one another by 3 inches, the wires 40 and 41 are spaced from one another by 3 inches, and the intermediate wire 42 is spaced from the upper wire 38 by approximately 7 inches. The wires 12*a*, 38, 40 and 42 may typically be W3.5 to W12 wire and may be covered with an anticorrosive coating, such as zinc.

Figure 10:
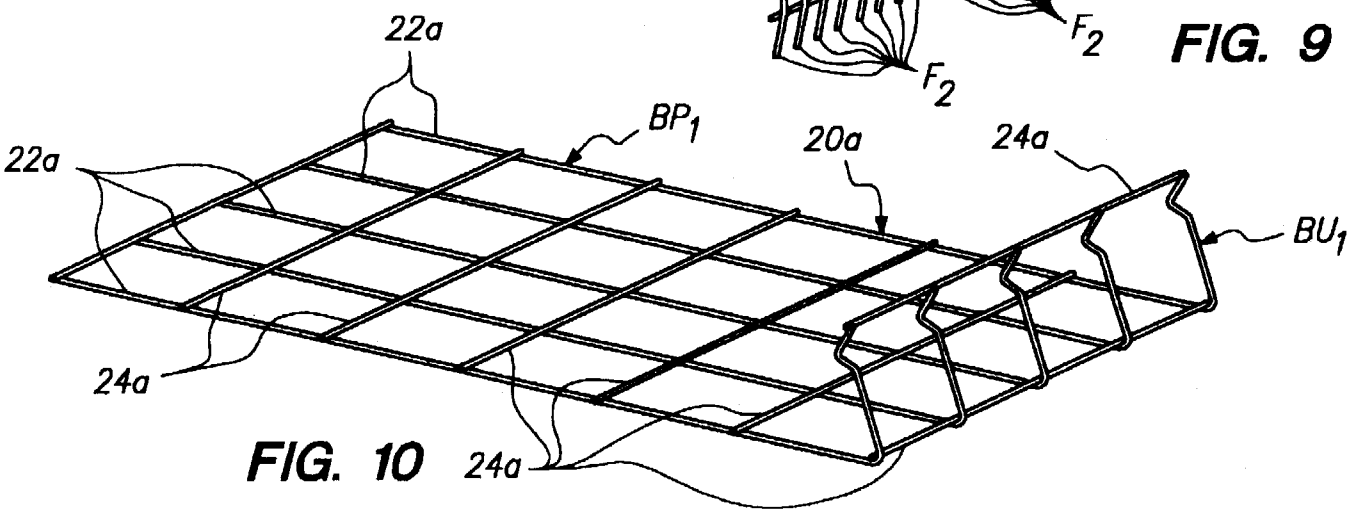
FIG. 10 is a perspective view of a welded wire soil reinforcing mat constructed according to the second embodiment of the present invention.

The soil reinforcing mat shown in FIG. 10 is designated in its entirety by the number 20*a* and comprises an elongate base portion $BP_1$ and a bent-up end $BU_1$. This construction is similar to that of the mat 20, except that the bent-up portion $BU_1$ extends at approximately 80° relative to the base portion $BP_1$, rather than the 90° configuration of the first embodiment (see FIG. 3). The longitudinal wires of the mat 20*a* are designated 22*a* and the transverse wires are designated 24*a*. These wires are typically W3.5 to W12 wire and are welded together at their intersections and coated with a suitable anticorrosive coating, such as zinc. Typical dimensions for the mats 20*a*, as viewed in FIG. 10, are 3½ feet wide, 8 to 10 inches high, as measured over the height of the bent-up portion $BU_1$, and 0.7 times the wall height for the length of the base portion $BP_1$. With such dimensions, the wires 22*a* may be spaced by 6 to 12 inches and the wires 24*a* may be spaced by 12 to 24 inches. The longitudinal wires 22*a* extending across the bent-up portion $BU_1$ are formed with inwardly extending kinks 26*a* disposed for extension through a face mat 10*a* nested therewith (see FIG. 13). These kinks are adapted to have a retaining rod or pin P (see FIG. 3) extended therethrough.

Figure 13:
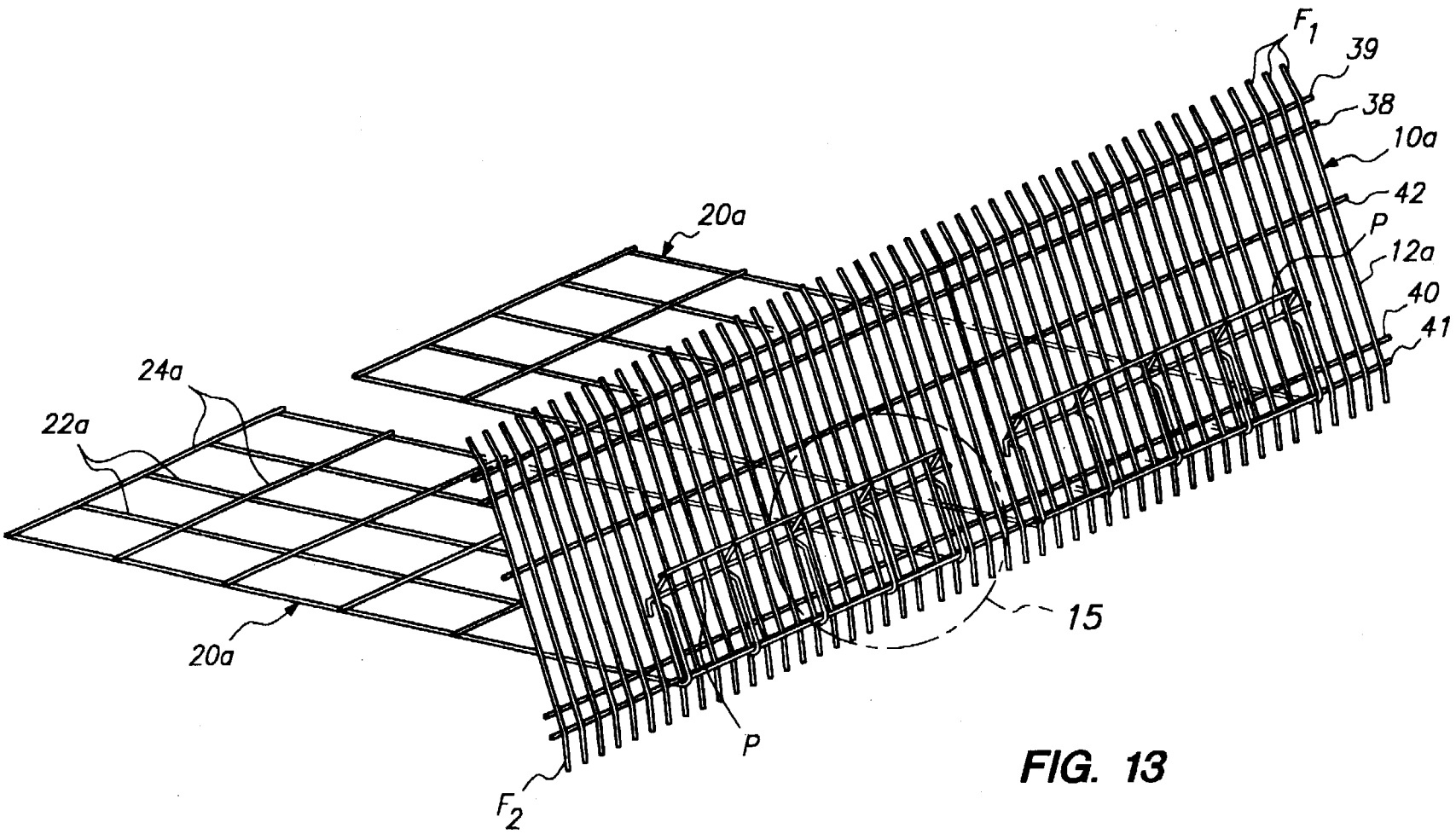
FIG. 13 is a perspective view of the combined face and soil reinforcing mat components of the second embodiment of the present invention.
Figure 15:
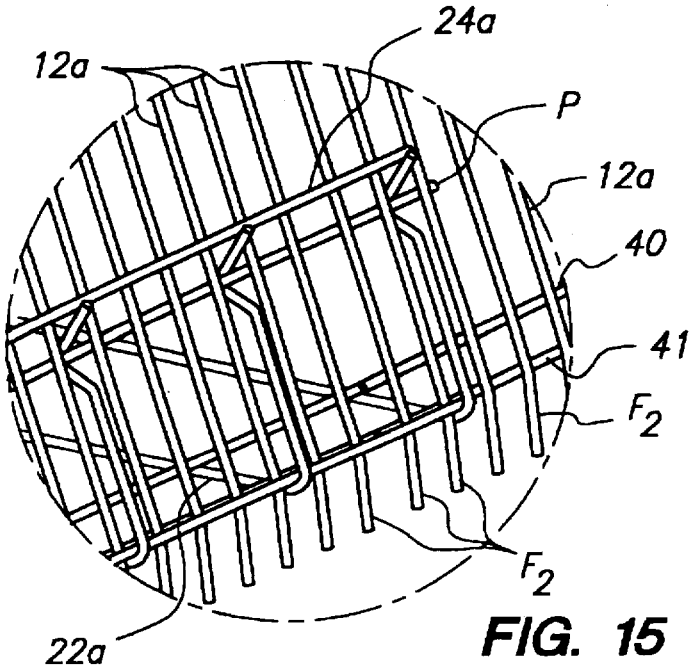
FIG. 15 is an enlarged perspective view taken within the circle 15 of FIG. 13.
Figure 16:
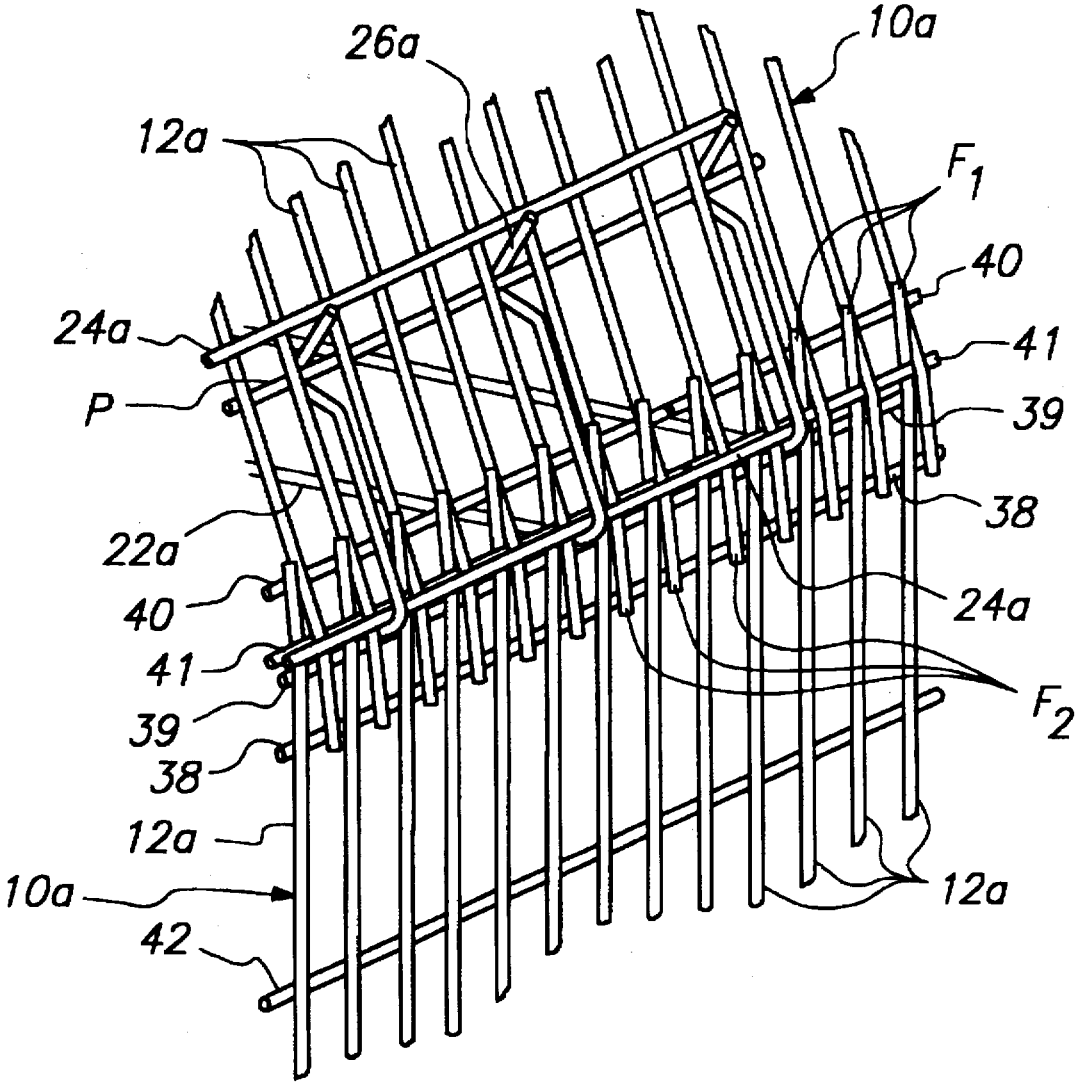
FIG. 16 is a perspective view showing a second course of assembled face and soil reinforcing mats of the second embodiment in the course of being threaded over the first course of such mats, as would occur during the construction of a wall comprised of several courses of assembled soil reinforcing and face mat combinations.

The second embodiment mats are assembled as shown in FIGS. 13, 15 and 16 with the face mat 10*a* disposed behind the bent-up end portion $BU_1$ of the soil reinforcing mat 20*a*. In this condition the lowermost fingers F2 extended beyond the bottom of the bent-up portion $BU_1$ and behind the transverse wire 24*a* at the intersection of the base portion $BP_1$ and the bent-up portion $BU_1$. With the mats so assembled, the lower transverse wire 41 rests on the longitudinal wires 22*a*, the kinks 26*a* extend between the wires 12*a* and a pin P is extended through the kinks 26*a* to secure the mats in assembled condition.

Figure 11:
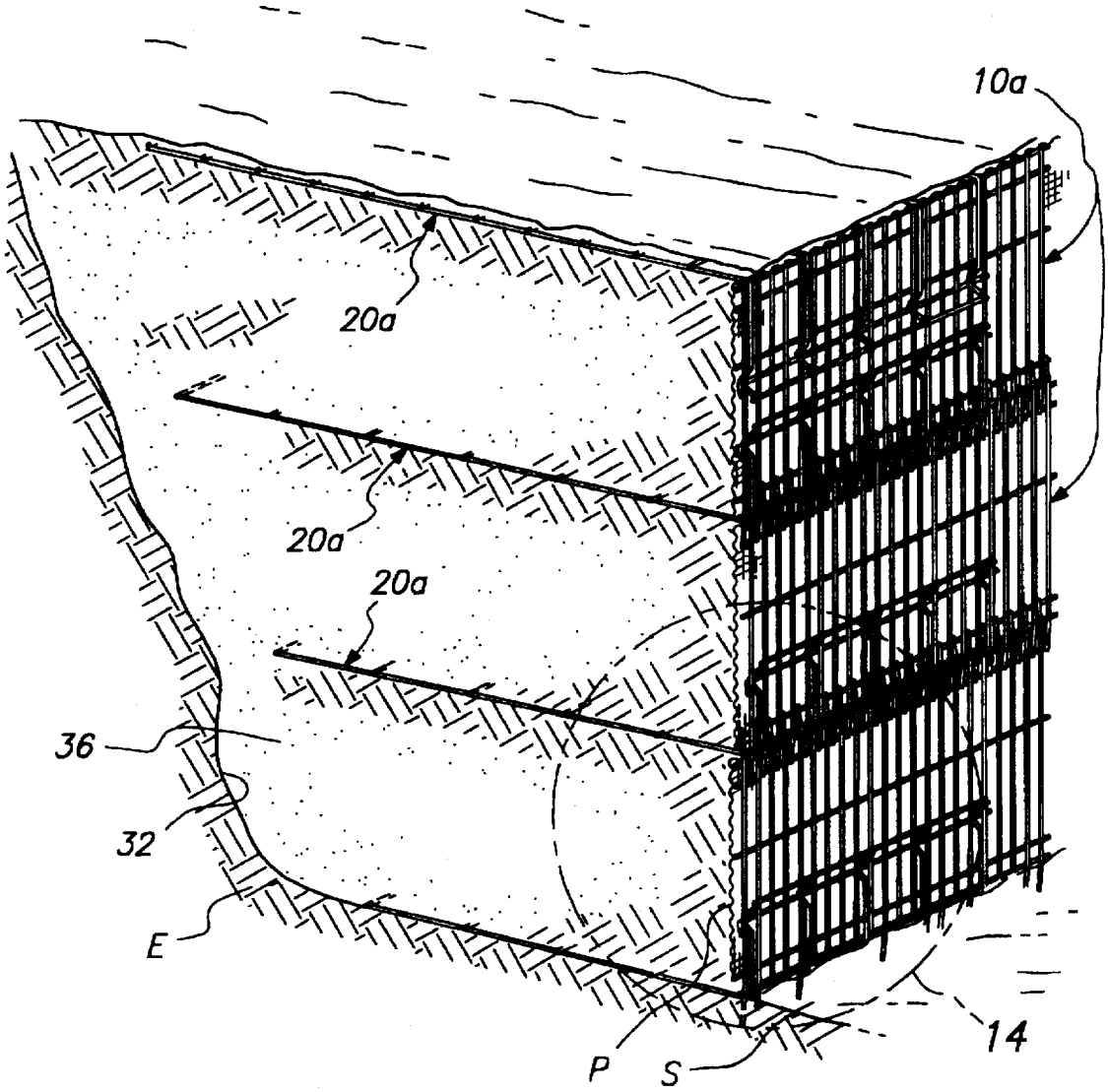
FIG. 11 is a perspective view of a soil reinforced retaining wall constructed according to the second embodiment of the present invention.

FIG. 11 shows a soil reinforced wall constructed according to the second embodiment of the present invention. As there illustrated, the earthen formation is designated E and is shown having a cut face 32. In erecting the wall shown in FIG. 11, the lowermost soil reinforcing mat 20*a* is first placed on the surface S of the formation with the bent-up portion $BU_1$ extending upwardly and the soil reinforcing mat 20*a* locked in place with a pin P, as may be seen in FIGS. 14 and 15. Filter mat 30 is then placed behind the upright portion UP1 and backfill soil 36 is filled in behind the filter mat to approximately the level of the upper crosswire 39 and compacted so as to force the upright portion UP1 of the face mat to a generally vertically disposition disposed at approximately 90° relative to the base portion $BP_1$ of the soil reinforcing mat. During the course of such compaction, the bent-up end portion $BU_1$ of the soil reinforcing mat 20*a* resists compactive force from backfill placement and is deflected to a condition extending at approximately 90° relative to the base portion $BP_1$ of the mat. In constructing the wall, the relative vertical disposition of the face panel mat is monitored as the backfill soil is compacted. Movement of the face panel mat to the vertical position in response to such compaction serves as an indication that compaction has been completed. Thus, the second embodiment wall provides a means of assuring that the backfill soil has been adequately compacted.

Figure 14:
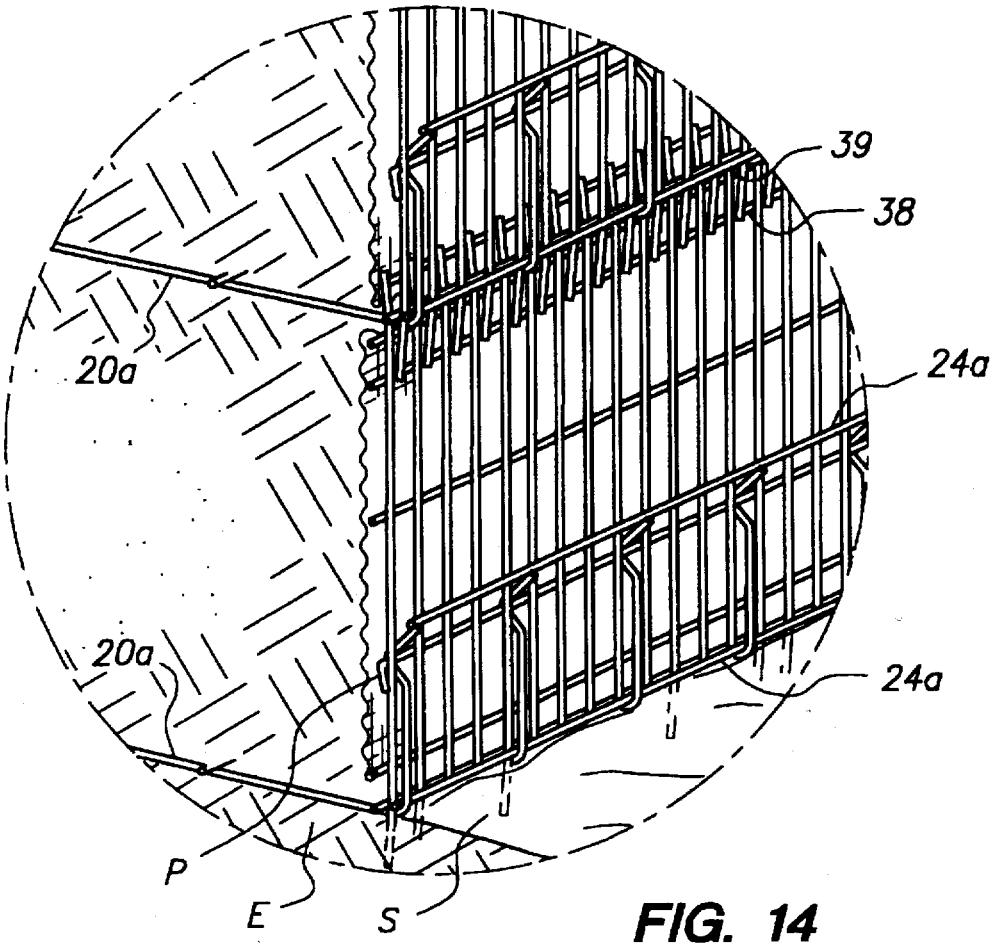
FIG. 14 is an enlarged perspective view taken within the circle 14 of FIG. 11.

With the lowermost face mat 10*a* and soil reinforcing mat 20*a* in place and the backfill soil compacted as described above, the second level face mat 10*a* and soil reinforcing mat 20*a* are assembled and then engaged over the upper fingers F1 of the lowermost face mat so that these fingers extend behind the transverse wire 24*a* at the intersection of the base portion $BP_1$ and bent-up portion $BU_1$ of the next soil reinforcing mat 20*a* and to the back of the transverse wire 41 the front of the transverse wire 40 of the second level face mat 10*a* (see FIGS. 14 and 16). With the first and second level mats so assembled, the lower fingers F2 of the second level face mat extend behind the transverse wire 39 and over and to the front of the transverse wire 38 of the first level face mat (see FIGS. 14 and 16). Once the first and second level face mats are so placed, compaction of backfill soil behind the second level mats forces the second level face mat to a generally vertical disposition and, in turn brings the upper fingers F1 of the lower face mat and the lower fingers F2 of the upper face mat into engagement with the transverse wires 38, 39, 40 and 41. During such engagement, a high degree of friction is created between the fingers and the transverse wires with which they are engaged, thus assuring a secure connection between the mats of successive lifts of the wall.

During the course of completing the second lift, filter mat 30 is placed behind the face mat 10*a* of the second lift and backfill soil is filled in and compacted to the level of the upper wire 39 of the second lift face mat. Compaction is monitored to make certain that it is sufficient to move the second level face mat to a generally vertically disposition.

The process of successively assembling face and soil reinforcing mats into the condition shown in FIG. 13 and then hooking them over the upper fingers F1 of the face mat therebelow is repeated to complete the second lift. Filter mat 30, and compacted backfill 36 is then again placed to the level of the top upper wire 39 of the next face mat so placed. When the composite soil reinforced wall reaches the top of the earthen formation to be retained, the process is complete. The final anchoring of the upper end of the uppermost face mat can be achieved by inverting a soil reinforcing mat and hooking it over the face mat therebelow, as shown at the top of FIG. 11.

Figure 12:
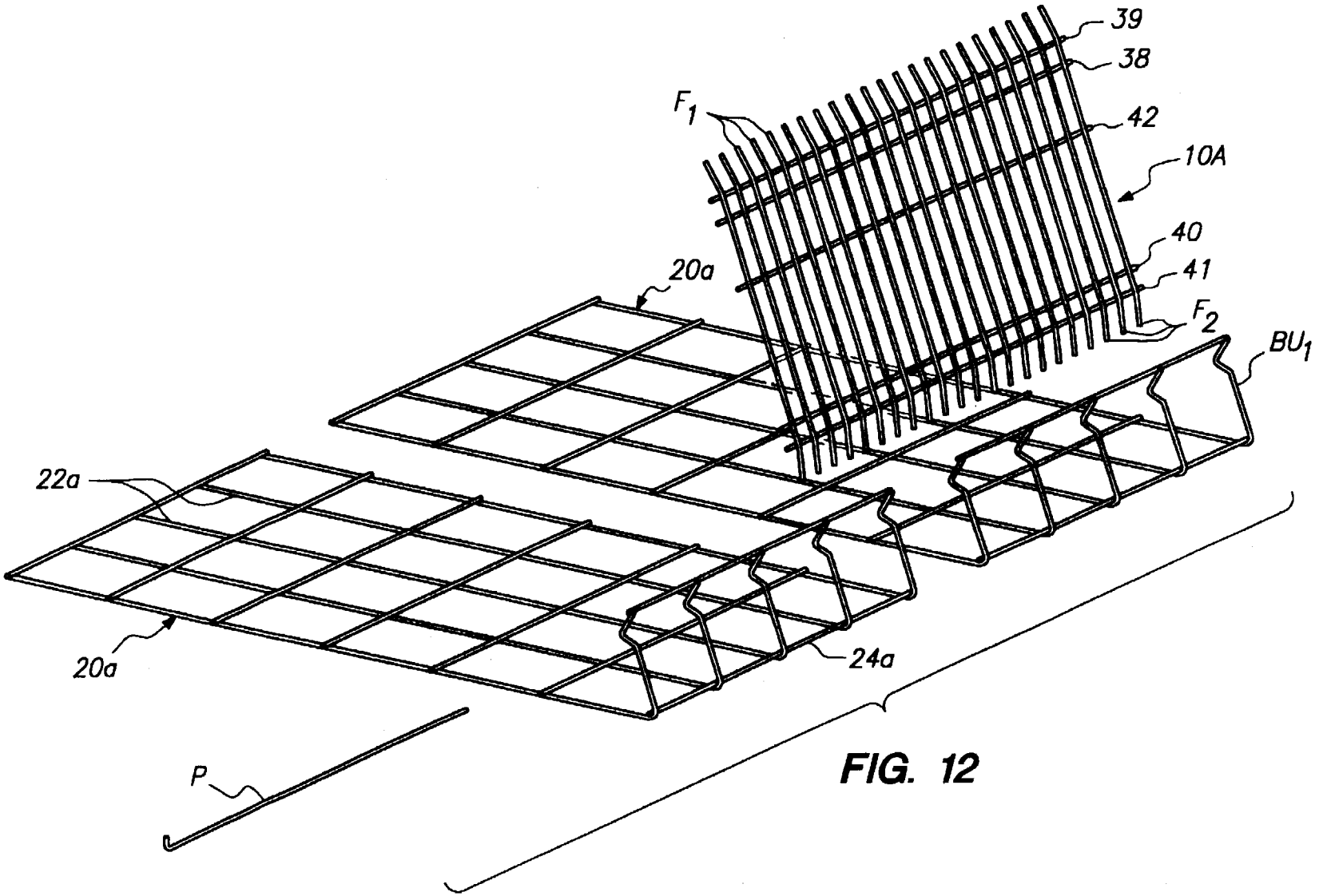
FIG. 12 is a exploded perspective view showing the interrelationship between a face mat and a pair of soil reinforcing mats constructed according to the second embodiment of the present invention.

FIG. 12 shows how a pair of soil reinforcing mats 20*a* may be disposed below and at either end of a face mat 10*a*. As shown in this figure, the soil reinforcing mats are spaced and the face mat is exploded thereabove. In the assembled (non-exploded) condition, the face mat 10*a* would be engaged behind the bent-up portion $BU_1$ of the soil reinforcing mats 20*a* and held in place by retaining pins P.

FIG. 13 shows two soil reinforcing mats 20*a* secured together in spaced relationship by a face mat 10*a*. As there shown, each soil reinforcing mat is hooked under the face mat with the bent-up portion $BU_1$ thereof secured to the face mat by a retaining pin P. While not illustrated in FIG. 13, it should be appreciated that the soil reinforcing mats of the second embodiment may be disposed in spanning relationship to a pair of face panels disposed in edge-to-edge relationship (similar to what is shown in FIG. 7) to secure the face panels together.

DESCRIPTION OF THE MODIFIED FIRST EMBODIMENT

Figure 17:
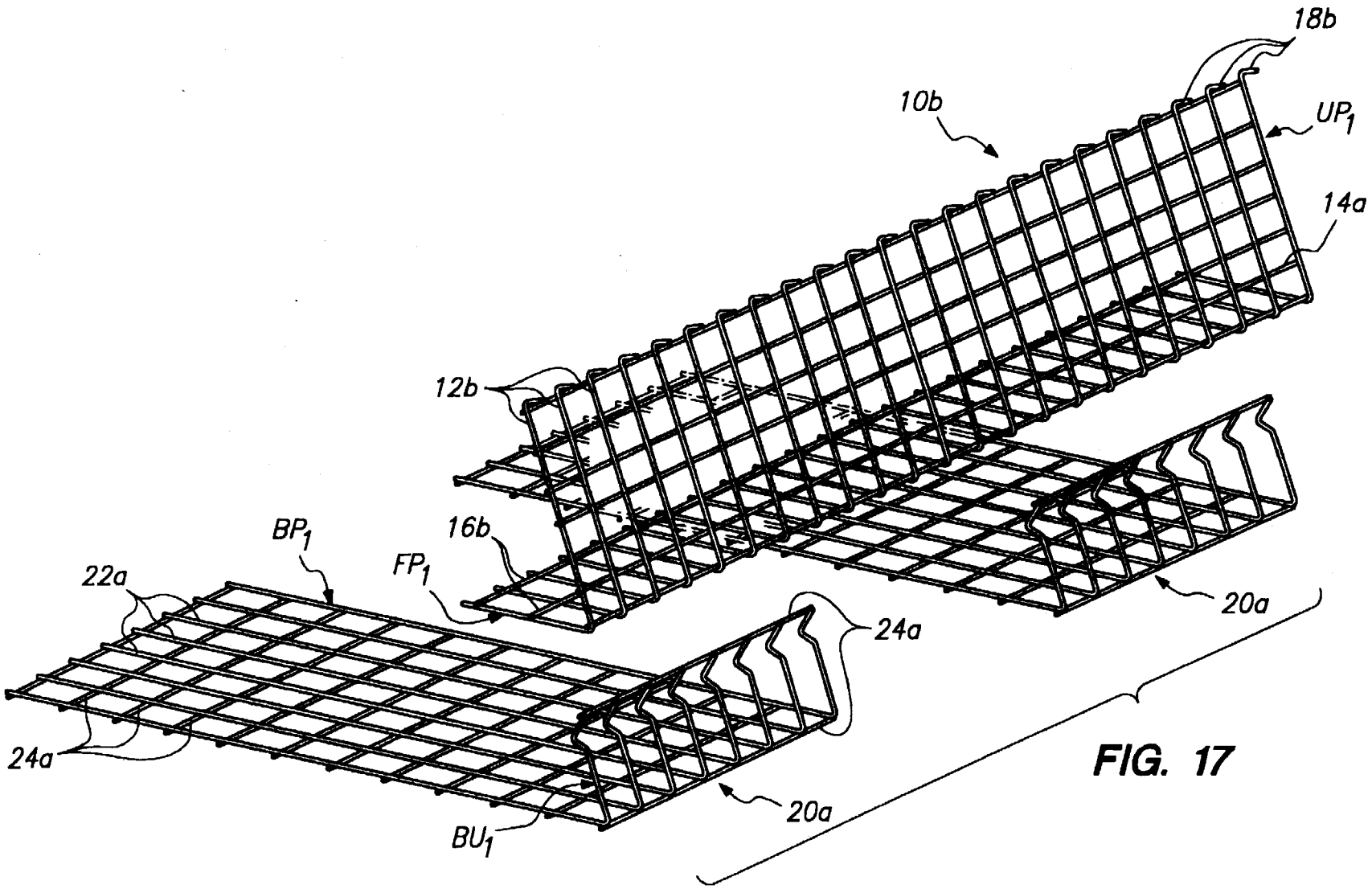
FIG. 17 is an exploded perspective view of a modified version of the first embodiment of the present invention wherein the bent-up end of the soil reinforcing mat and the upright portion of the face mat are initially sloped back toward the formation being retained, showing the interrelationship between a face mat and a pair of soil reinforcing mats.
Figure 18:
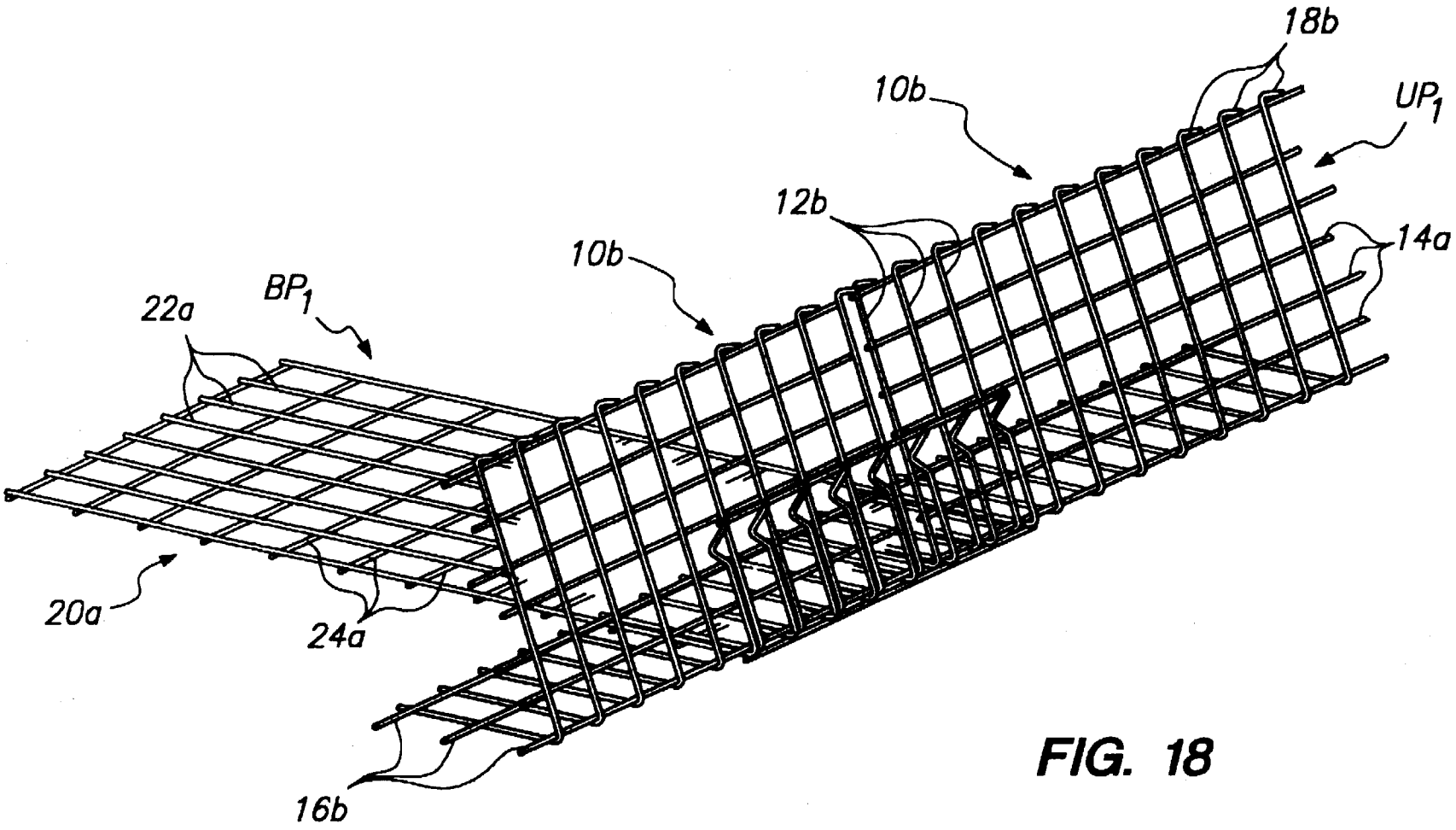
FIG. 18 is a perspective view of the modified version of the first embodiment shown in FIG. 17, illustrating a pair of face mats disposed in edge-to-edge relationship and spanned by a soil reinforcing mat.

This embodiment is shown in FIGS. 17 and 18 and differs from the first embodiment in that the soil reinforcing mats, designated 20*a*, correspond to those of the second embodiment and that the face mats, designated 10*b*, have an upright portion UP1 extending at an angle of 80° relative to the floor portion FP1. The elements of soil reinforcing mat 20*a* of this modified embodiment are designated by the same numerals used to designate the elements of soil reinforcing mat 20*a* of the second embodiment. The elements of the face mat 10*b* corresponding to those of the mat 10 of the first embodiment are designated by like numerals followed by the letter "b", as follows: longitudinal wires 12*b*; transverse wires 14*b*; transverse wires 16*b*; and prongs 18*b*.

In use of the modified first embodiment, the face mats 10*b* and soil reinforcing mats 20*a* are nested together in the same manner herein described and illustrated with respect to the first embodiment. FIG. 18 shows the mats so assembled. Although not illustrated, it should be understood that the assembled mats would be held together with a pin P.

In erecting a soil reinforced wall with the modified first embodiment, the assembled soil reinforcing mats and face mats are placed in the earthen formation in the same manner illustrated and described with respect to the first embodiment, with filter mats 30 disposed behind the upright portions UP1 of the face mats. Backfill soil is then placed and compacted. During the course of such compaction, the bent-up end $BU_1$ of the soil reinforcing mat 20*a* and the upright portion UP1 of the face mat 10*b* resist compactive force from backfill placement and are deflected to a condition extending at approximately 90° relative to the base portion $BP_1$ of the mat 20*a*. Like the second embodiment, in constructing the modified first embodiment wall, the relative vertical disposition of the face panel mat is monitored as the backfill soil is compacted. Movement of the face panel to the vertical position in response to such compaction serves as an indication that compaction has been completed. Thus, the modified first embodiment, like the second embodiment, provides means for assuring that backfill soil has been adequately compacted.

The steps of creating a soil reinforced wall with a modified first embodiment correspond to those which have been illustrated and described with respect to the unmodified first embodiment. The only difference being that with the modified first embodiment compaction to move the upright portion UP1 of the face mats must be sufficient to move the face mats to a vertical disposition.

CONCLUSION

From the foregoing detailed description, it is believed apparent that the present invention enables the attainment of the objects initially set forth herein. In particular, the invention provides a soil reinforced wall wherein separate mats are provided for the soil reinforcing and face functions in order that each may be optimally designed and the lift between successive soil reinforcing mats may be increased. The invention also provides for spacing and staggering of the soil reinforcing mats so as to reduce the weight of material required to construct the retaining wall. It should be understood, however, that the invention is not intended to be limited to the specifics of the illustrated embodiments, but rather is defined by the accompanying claims.

I claim:

1. A retaining wall structure for the face of an earthen formation, said structure comprising:

a) successive angle-shaped welded wire face mats having relatively short floor portions extending into the formation in generally vertically spaced relationship to one another and upright portions secured to one another and extending between the floor portions at the face of the formation;

b) elongate welded wire soil reinforcing mats with bent-up ends of a height less than the distance between the floor portions of successive face mats, said reinforcing mats being engaged with the floor portions of the face mats so as to extend therebeyond into the earthen formation with the bent-up ends extending partially over the upright portions of the face mats; and, c) means securing the bent-up ends of the soil reinforcing mats to the upright portions of the face mats over which said bent-up ends extend.

2. A retaining wall structure according to claim 1 wherein:

a) the upright portions of the face mats extend at an acute angle relative to the floor portions of the face mats to resist compactive force from backfill placement behind the upright portions; and, b) the bent-up ends of the soil reinforcing mats compliment the upright portions of the face mats when engaged therewith to resist compactive force from backfill placement behind the upright portions to the face mats.

3. A retaining wall according to claim 2 wherein the upright portions of the face mats are deflectable to generally right angled relationship relative to the floor portions responsive to the compaction of soil behind the upright portions.

4. A retaining wall structure according to claim 1 wherein said means comprises:

a) kinks formed on the bent-up ends of the reinforcing mats and extending through the upright portions of the face mats; and, b) rods extending through the kinks to secure the upright portions of the face mats against separation from the bent-up ends of the soil reinforcing mats.

5. A retaining wall structure according to claim 1 wherein:

a) the face mats have a width greater than the width of the soil reinforcing mats and at least certain of the face mats are disposed in levels in adjacent edge-to-edge relationship; and, b) at least certain of the soil reinforcing mats are secured to and span adjacent face mats.

6. A retaining wall structure according to claim 5 wherein the soil reinforcing mats spanning adjacent face mats are spaced from one another.

7. A retaining wall structure according to claim 1, further comprising bent distal ends on the upright portions of the face mats for engagement with a successive face mat.

8. A mat combination for use in constructing a soil reinforced retaining wall at the face of an earthen formation, said combination comprising:

a) an angle-shaped welded wire face mat having a relatively short floor portion for extension into the earthen formation and an upright portion of an extended height for disposition over a portion of the face of the formation;

b) an elongate welded wire soil reinforcing mat with a bent-up end of a height less than that of that of the upright portion of the face mat, said reinforcing mat being complemental to and engaged with and extending beyond the floor portion of the face mat with the bent-up end extending partially over the upright portion; and, c) means securing the bent-up end of the soil reinforcing mat to the upright portion of the face mat.

9. A combination according to claim 8, wherein:

a) the upright portion of the face mat extends at an acute angle relative to the floor portion of the face mat to resist compactive force from backfill placement; and, b) the bent-up end of the soil reinforcing mat compliments the upright portion of the face mats when engaged therewith and is deflectable therewith to resist compactive force from backfill placement behind the upright portion to the face mat.

10. A combination according to claim 9 wherein the upright portion of the face mat is deflectable to generally right angled relationship relative to the floor portion responsive to the compaction of soil behind the upright portion of the face mat.

11. A combination according to claim 8 wherein said means comprises:

a) a kink formed on the bent-up end of the reinforcing mat and extending through the upright portion of the face mat; and, b) a rod extending through the kink to secure the upright portion of the face mat against separation from the bent-up end of the soil reinforcing mat.

12. A combination according to claim 8, further comprising a bent distal end on the upright portion of the face mat for engagement with a like mat used to construct a retaining wall.

13. A method of constructing a retaining wall for the face of an earthen formation, said method comprising:

a) providing successive angle-shaped welded wire face mats having generally vertically spaced relative short floor portions extending into the formation and upright portions secured to one another at the face of the formation;

b) providing elongate welded wire soil reinforcing mats with bent-up ends of a height less than the space between the floor portions of successive face mats and engaging said reinforcing mats with the floor portions of the face mats so as to extend therebeyond into the earthen formation with the bent-up ends extending partially over the upright portions of the face mats; and, c) securing the bent-up ends of the soil reinforcing mats to the upright portions of the face mats over which said bent-up ends extend.

14. A method according to claim 13 wherein the bent-up ends of the soil reinforcing mats are secured to the upright portions of the face mats by:

a) kinks formed on the bent-up ends of the reinforcing mats and extending through the upright portions of the face mats; and, b) rods extending through the kinks to secure the upright portions of the face mats against separation from the bent-up ends of the soil reinforcing mats.

15. A method according to claim 13 wherein:

a) the face mats have a width greater than the width of the soil reinforcing mats and at least certain of the face mats are disposed in levels in adjacent edge-to-edge relationship; and, b) at least certain of the soil reinforcing mats are secured to and span adjacent face mats.

16. A method according to claim 15 wherein the soil reinforcing mats spanning adjacent face mats are spaced from one another.

17. A method according to claim 13 wherein the soil reinforcing mats have elongate body portions for extension into the earthen formation and the bent-up ends of the soil reinforcing mats extend at an acute angle with respect to the body portions thereof to resist compactive force from backfill placement behind the upright portions of the face mats, said method further comprising compacting the earthen formation behind the face mats to bend the bent-up ends to a disposition disposed at generally a right angle with respect to the body portions.

18. A mat combination for use in constructing soil reinforced earthen retaining walls, said combination comprising:

a) an angle-shaped welded wire face mat having a floor portion for extension into an earthen formation and an upright portion of an extended height for disposition over a face portion of an earthen formation;

b) an elongate welded wire soil reinforcing mat with a bent-up end of a height less than that of the upright portion of the face mat, said reinforcing mat being complemental with and juxtaposed to the face mat for extension into an earthen formation with the bent-up end extending partially over the upright portion of the face mat; and, c) means securing the bent-up end of the soil reinforcing mat to the upright portion of the face mat.

19. A combination according to claim 18 wherein said means comprises:

a) a kink formed on the bent-up end of the reinforcing mat and extending through the upright portion of the face mat; and, b) a rod extending through the kink to secure the upright portion of the face mat against separation from the bent-up end of the soil reinforcing mat.

20. A combination according to claim 18, further comprising a bent distal end on the upright portion of the face mat for engagement with a like mat used to construct a retaining wall.

21. A retaining wall structure for the face of an earthen formation, said structure comprising:

a) successive welded wire face mats having upright portions of an extended height secured to one another at the face of the formation;

b) elongate welded wire soil reinforcing mats with bent-up ends of a height less than the height of the upright portions of the face mats, said reinforcing mats being secured beneath the face mats so as to extend into the earthen formation at vertically spaced levels with the bent-up ends extending partially over the upright portions of the face mats; and, c) means securing the bent-up ends of the soil reinforcing mats to the upright portions of the face mats over which said bent-up ends extend.

22. A retaining wall structure according to claim 21 wherein the soil reinforcing mats have elongate body portions for extension into the earthen formation and the bent-up ends of the soil reinforcing mats extend at an acute angle with respect to the body portions thereof to resist compactive force from backfill placement.

23. A retaining wall structure according to claim 22 wherein the bent-up ends of the soil reinforcing mats are deflectable to generally right angled relationship relative to the elongate body portions of the soil reinforcing mats responsive to the compaction of soil behind the upright portions to the face mats.

24. A retaining wall structure according to claim 21 wherein:

a) the upright portions of the face mats have upper and lower ends, each with a pair of closely spaced transverse wires upper extending thereacross; and, b) the fingers of at least certain of said face mats extend over and under the paired transverse wires of a successive face mat.

25. A retaining wall structure according to claim 24 wherein the bent-up ends of at least certain of the soil reinforcing mats extend around and to the outside of the paired transverse wires at the lower end of the upright portion of said certain face mats.

26. A retaining wall structure according to claim 21 wherein said means comprises:

a) kinks formed on the bent-up ends of the reinforcing mats and extending inwardly through the upright portions of the face mats; and, b) rods extending through the kinks to secure the upright portions of the face mats against separation from the bent-up ends of the soil reinforcing mats.

27. A retaining wall structure according to claim 21 wherein:

a) the face mats have a width greater than the width of the soil reinforcing mats; and, b) at least certain of the soil reinforcing mats are secured to and span adjacent face mats.

28. A retaining wall structure according to claim 27 wherein the soil reinforcing mats spanning adjacent face mats are spaced from one another.

29. A retaining wall structure according to claim 21, further comprising bent distal ends on the upright portions of the face mats for engagement with a successive face mat.

30. A mat combination for use in constructing a soil reinforced retaining wall at the face of an earthen formation, said combination comprising:

a) a welded wire face mat having an upright portion of an extended height for disposition over a portion of the face of the formation;

b) an elongate welded wire soil reinforcing mat with a bent-up end of a height less than that of that of the upright portion of the face mat, said reinforcing mat being complemental with and disposed beneath the face mat so that the bent-up portion extends partially over the upright portion of the face mat; and, c) means securing the bent-up end of the soil reinforcing mat to the upright portion of the face mat.

31. A combination according to claim 30, wherein the soil reinforcing mat has an elongate body portion for extension into the earthen formation and the bent-up end of the soil reinforcing mat extends at an acute angle with respect to the body portion thereof to resist compactive force from backfill placement.

32. A combination according to claim 31 wherein the bent-up end of the soil reinforcing mat is deflectable to generally right angled relationship relative to the elongate body portion of the soil reinforcing mat responsive to the compaction of soil behind the upright portion to the face mat.

33. A combination according to claim 30 wherein said means comprises:

a) a kink formed on the bent-up end of the reinforcing mat and extending inwardly through the upright portion of the face mat; and, b) a rod extending through the kink to secure the upright portion of the face mat against separation from the bent-up end of the soil reinforcing mat.

34. A combination according to claim 30, further comprising a bent distal end on the upright portion of the face mat for engagement with a like mat used to construct a retaining wall.

35. A method of constructing a retaining wall for the face of an earthen formation, said method comprising:

a) providing successive welded wire face mats having upright portions of an extended height secured to one another at the face of the formation;

b) providing elongate welded wire soil reinforcing mats with bent-up ends of a height less than that of the upright portion of the face mats and securing said reinforcing mats beneath the face mats so as to extend into the earthen formation with the bent-up ends extending partially over the upright portions of the face mats; and, c) securing the bent-up ends of the soil reinforcing mats to the upright portions of the face mats over which said bent-up ends extend.

36. A method according to claim 35 wherein the bent-up ends of the soil reinforcing mats are secured to the upright portions of the face mats by:

a) kinks formed on the bent-up ends of the reinforcing mats and extending inwardly through the upright portions of the face mats; and, b) rods extending through the kinks to secure the upright portions of the face mats against separation from the bent-up ends of the soil reinforcing mats.

37. A method according to claim 35 wherein:

a) the face mats have a width greater than the width of the soil reinforcing mats; and, b) at least certain of the soil reinforcing mats are secured to and span adjacent face mats.

38. A method according to claim 37 wherein the soil reinforcing mats spanning adjacent face mats are spaced from one another.

39. A method according to claim 35 wherein the soil reinforcing mats have elongate body portions for extension into the earthen formation and the bent-up ends of the soil reinforcing mats extend at an acute angle with respect to the body portions thereof, said method further comprising compacting the earthen formation behind the face mats to bend to the bent-up ends to a disposition disposed at generally a right angle with respect to the body portions.

40. A mat combination for use in constructing soil reinforced earthen retaining walls, said combination comprising:

a) a welded wire face mat having an upright portion of an extended height for disposition over a face portion of an earthen formation;

b) an elongate welded wire soil reinforcing mat with a bent-up end of a height less than that of the upright portion of the face mat, said reinforcing mat being complemental with and juxtaposed to the face mat for extension into an earthen formation with the bent-up end extending partially over the upright portion of the face mat; and, c) means securing the bent-up end of the soil reinforcing mat to the upright portion of the face mat.

41. A mat combination according to claim 40 wherein the soil reinforcing mat has an elongate body portion for extension into the earthen formation and the bent-up end of the soil reinforcing mat extends at an acute angle with respect to the body portion thereof to resist compactive force from backfill placement.

42. A mat combination according to claim 41 wherein the bent-up end of the soil reinforcing mat is deflectable to generally right angled relationship relative to the elongate body portion of the soil reinforcing mat responsive to the compaction of soil behind the upright portion to the face mat.

43. A combination according to claim 40 wherein said means comprises:

a) a kink formed on the bent-up end of the reinforcing mat and extending through the upright portion of the face mat; and, b) a rod extending through the kink to secure the upright portion of the face mat against separation from the bent-up end of the soil reinforcing mat.

44. A combination according to claim 40, further comprising a bent distal end on the upright portion of the face mat for engagement with a like mat used to construct a retaining wall.

45. A combination according to claim 40 wherein:

a) the soil reinforcing mat has an elongate body portion for extension into an earthen formation;

b) the bent-up end of the soil reinforcing mat extends at an acute angle with respect to the body portion; and, c) the bent-up end is adapted to bend to a disposition disposed at a right angle with respect to the body portion upon loading of the face mat as the result of the compaction of soil behind the face mat.

46. A combination according to claim 40, wherein the upright portion of the face mat has fingers for extension behind the bent-up portion and over the face mat of a like combination used to construct a retaining wall.

47. A combination according to claim 46 wherein:

a) the upright portion of the face mat has upper and lower ends, each with a pair of closely spaced transverse wires upper extending thereacross; and, b) the fingers extend beyond said wires for extension over and under the paired transverse wires of the face mat of a like combination used to construct a retaining wall.

48. A combination according to claim 47 wherein the bent-up end of the soil reinforcing mat extends around and to the outside of the paired transverse wires at the lower end of the upright portion of the face mat and one of the paired transverse wires at the lower end of the upright portion rests on the soil reinforcing mat.

* * * * *